US006684840B1

(12) United States Patent
Kuwano et al.

(10) Patent No.: US 6,684,840 B1
(45) Date of Patent: Feb. 3, 2004

(54) INTAKE MODULE, WIRING MODULE AND CONTROL MODULE FOR INTERNAL COMBUSTION ENGINE

(75) Inventors: Morio Kuwano, Nishiibaraki-gun (JP); Shigeto Niitsuma, Mito (JP); Teruhiko Minegishi, Hitachinaka (JP); Mitsunori Nishimura, Hitachinaka (JP)

(73) Assignees: Hitachi, Ltd., Tokyo (JP); Hitachi Car Engineering Co., Ltd., Hitachinaka (JP)

( * ) Notice: Subject to any disclaimer, the term of this patent is extended or adjusted under 35 U.S.C. 154(b) by 0 days.

(21) Appl. No.: 09/763,986

(22) PCT Filed: Oct. 27, 1999

(86) PCT No.: PCT/JP99/05936

§ 371 (c)(1),
(2), (4) Date: Feb. 28, 2001

(87) PCT Pub. No.: WO01/31189

PCT Pub. Date: May 3, 2001

(51) Int. Cl.[7] ..... F02M 35/10
(52) U.S. Cl. ..... 123/184.21; 123/143 C
(58) Field of Search ..... 123/520, 184.21, 123/184.61, 184.34, 143 C, 337, 195 E, 543, 549

(56) References Cited

U.S. PATENT DOCUMENTS 5,016,579 A * 5/1991 Suzuki et al. ..... 123/184.35
5,341,773 A * 8/1994 Schulte et al. ..... 123/184.61
5,390,648 A * 2/1995 Yanase ..... 123/634
5,568,794 A * 10/1996 Tabuchi et al. ..... 123/195 E
5,713,322 A * 2/1998 Mausner et al. ..... 123/184.21
6,003,490 A * 12/1999 Kihara et al. ..... 123/337
6,186,106 B1 * 2/2001 Glovatsky et al. ..... 123/184.61

* cited by examiner

*Primary Examiner*—Henry C. Yuen
*Assistant Examiner*—Hyder Ali
(74) *Attorney, Agent, or Firm*—Crowell & Moring LLP

(57) ABSTRACT

An intake manifold and a collector made of synthetic resin are molded integrally to constitute a body of an intake module. A synthetic resin holder for holding at least one of a harness and a piping member (a pipe for hot water, and a canister purge pipe) is mounted at the upper part of the intake module body to incorporate the harness and/or piping member as an intake module element. Further, an engine control unit, an injector, a throttle body and so on are also incorporated into the module body to progress formation of an intake system of the internal combustion engine into module, and module elements are increased more than that presented previously to further enhance simplicity of vehicle assembling work, convenience of transportation, and mounting density, and to realize smaller and lighter weight, housing properties, and lower resistance of harness.

14 Claims, 10 Drawing Sheets

INTAKE MODULE, WIRING MODULE AND CONTROL MODULE FOR INTERNAL COMBUSTION ENGINE

BACKGROUND OF THE INVENTION

1. Technical Field

The present invention relates to an intake module, a wiring module and a control module for an internal combustion engine for an automobile and the like.

2. Background Art

There has been heretofore proposed a technique, in connection with an intake system of an internal combustion engine for an automobile and the like, which is intended to form an intake manifold and a collector (a surge tank) of synthetic resin and into integral molding, and further to form a throttle valve, a collector, an intake manifold, an injector and the like into a module as a single assembly, in order to achieve a smaller and lighter configuration and to enhance mounting density. A prior art intake module is disclosed in, for example, Japanese Patent Application Laid-Open Nos. Hei 6-81719, Hei 7-301163, Hei 7-83132 and the like.

SUMMARY OF THE INVENTION

It is an object of the present invention to provide, in an intake module, a wiring module and a control module for an internal combustion engine for an automobile and the like, an intake module of an internal combustion engine for an automobile and the like capable of further progressing formation into module more than that of prior art to increase module elements more than that of prior art, thereby enhancing further simplification of an assembling work of vehicles, convenience of transportation, smaller and lighter configuration, housing properties, and mounting density. A further object is to realize an intake module, which is intended to provide a shorter harness and a shorter piping, thus being advantageous in terms of cost and promoting lower resistance of a harness and noise resistance.

To achieve the aforementioned objects, the present invention is fundamentally constituted as follows:

(1) First, an intake module provided with an intake manifold and a collector made of synthetic resin constituting a module body, characterized in that a synthetic resin holder for holding at least one out of a harness and a piping member (for example, such as a pipe for hot water, a canister purge pipe and the like) is mounted on an upper part of the module body, and the harness and/or the piping member is incorporated as a module.

For example, a proposal is made in which the synthetic resin holder comprises an upper cover and a lower cover, the lower cover is secured upward to the intake module body, the upper cover is detachably mounted so as to cover the lower cover, a clasp for detachably securing a member to be held is disposed internally of the lower cover, and the synthetic resin holder is formed with a guide part for introducing the held member internally and externally of the holder.

With the constitution as described above, module elements are increased whereby a vehicle is formed into a smaller and lighter configuration, an electric system harness and a piping member are intensified to make an assembling work for vehicles simpler, an engine room being made higher in density is simplified, an effective space in the engine room is further increased, or parts can be mounted with high density into a narrow engine room. Further, a harness is formed into a module, and in connection therewith, controlled parts such as a control device such as ECU(Engine Control Unit), an injector and the like to be controlled, and various sensors are formed into a module along with the harness to enable making the harness shorter. Further, since the intake module is mounted in the engine room, the harness (module element) can be connected at a position close to electric parts (such as an ignition coil) on the engine side, which also leads to make the harness shorter. Accordingly, the resistance of the whole harness can be made small, and the noise resistance is promoted.

Further, the piping system can be shortened and rationalized by intensification, thus reducing the cost.

Moreover, as the invention for achieving the above-described objects, the fundamental constitution as described below is proposed.

(2) An intake module for an internal combustion engine constituted by an intake manifold, a collector, a throttle body and the like, characterized in that said module comprises a pipe for hot water having a length allowed to be incorporated into an intake module body, the pipe for hot water is housed in and held through a synthetic resin holder on a wall surface of the module body along with a harness, the pipe for hot water has one end connected through a hose to a hot water passage provided in a heat transfer part of the throttle body, the pipe for hot water, the hot water passage and the hose are incorporated as module elements, and the pipe for hot water has the other end connectable to an engine cooling water supply hose.

(3) An intake module for an internal combustion engine having an intake manifold and a collector made of synthetic resin, characterized in that an engine control unit and a synthetic resin holder having a harness holding function are secured to a wall surface of an intake module body, and a harness connected through a connector to the engine control unit is incorporated into the synthetic resin holder as an intake module element.

(4) An intake module for an internal combustion engine having an intake manifold and a collector made of synthetic resin, characterized in that a canister purge pipe is held by a holder on a wall surface of an intake module body, and the holder is provided with a protective cover for covering the canister purge.

(5) An intake module for an internal combustion engine having a throttle body, an intake manifold and a collector formed into a module, characterized in that the intake manifold and the collector is integrally formed of synthetic resin, the collector is positioned at a lower part of the synthetic resin molded body, an air intake port of the collector is projected laterally from intake manifold, the throttle body is secured to the air intake port of the collector, and an idle speed control valve provided on the throttle body is positioned between the throttle body and the intake manifold.

(6) An intake module for an internal combustion engine having a throttle body, an intake manifold and a collector formed into a module, characterized in that the intake manifold and the collector is integrally formed of synthetic resin, the collector is positioned at a lower part of the synthetic resin molded body, each curved independent intake pipe constituting the intake manifold is formed at one end thereof with an injector mounting part and an intake port peripheral part, an air intake part of the collector is located on one side of the intake manifold and is inclined upward and in a direction away from the intake manifold as the air intake part is extended upward, the throttle valve is mounted on a flange of the air intake part with the throttle body inclined in the same direction as the air intake part.

(7) A wiring module comprising a connector for ignition and a connector for an injector.

(8) A wiring module for an internal combustion engine comprising an ignition coil and a connector for connecting an injector to an engine control unit.

(9) A wiring module for an internal combustion engine comprising an ignition connector, a connector for an injector, a connecter for an air flow meter, and a connector for an engine control unit.

(10) A wiring module for an internal combustion engine comprising an ignition connector, a connector for an injector, a connecter for an electronically controlled throttle valve, and a connector for an engine control.

(11) A control module for an internal combustion engine wherein a wiring for connecting an engine control unit with an injector and an ignition coil is held on an outer wall part of a molded body of an independent intake pipe.

(12) A wiring module for an internal combustion engine characterized in that wiring is made by a single bundle from a connector of ECU, from which is branched into a bundle on an ignition coil side, and a bundle on an injector side.

(13) A control module for an internal combustion engine, wherein ignition coils are mounted independently every cylinder on a cylinder head part of the engine, an independent intake pipe molded body constituting an intake manifold is mounted on the side of the engine, an injector is mounted around an intake port of the engine at a part between the intake pipe molded body and the ignition coil, an engine control unit is mounted on the side, of the intake pipe molded body, farthest from the engine, and a wiring bundle is held by the intake pipe molded body at a part between the engine control unit and the injector.

(14) Various relative inventions (as claimed) dependent on the above inventions are proposed other than the above inventions. The above fundamental constitution and the detailed constitution and operation, effect relative thereto will be described in the embodiments.

DESCRIPTION OF THE PREFERRED EMBODIMENTS

Embodiments of the present invention will be described hereinafter with reference to the drawings.

First, prior to explaining the constitution of an intake module for an internal combustion engine for an automobile according to the present invention, the outline of an engine system to which the former is applied will be described with reference to FIG. 9.

Figure 9:
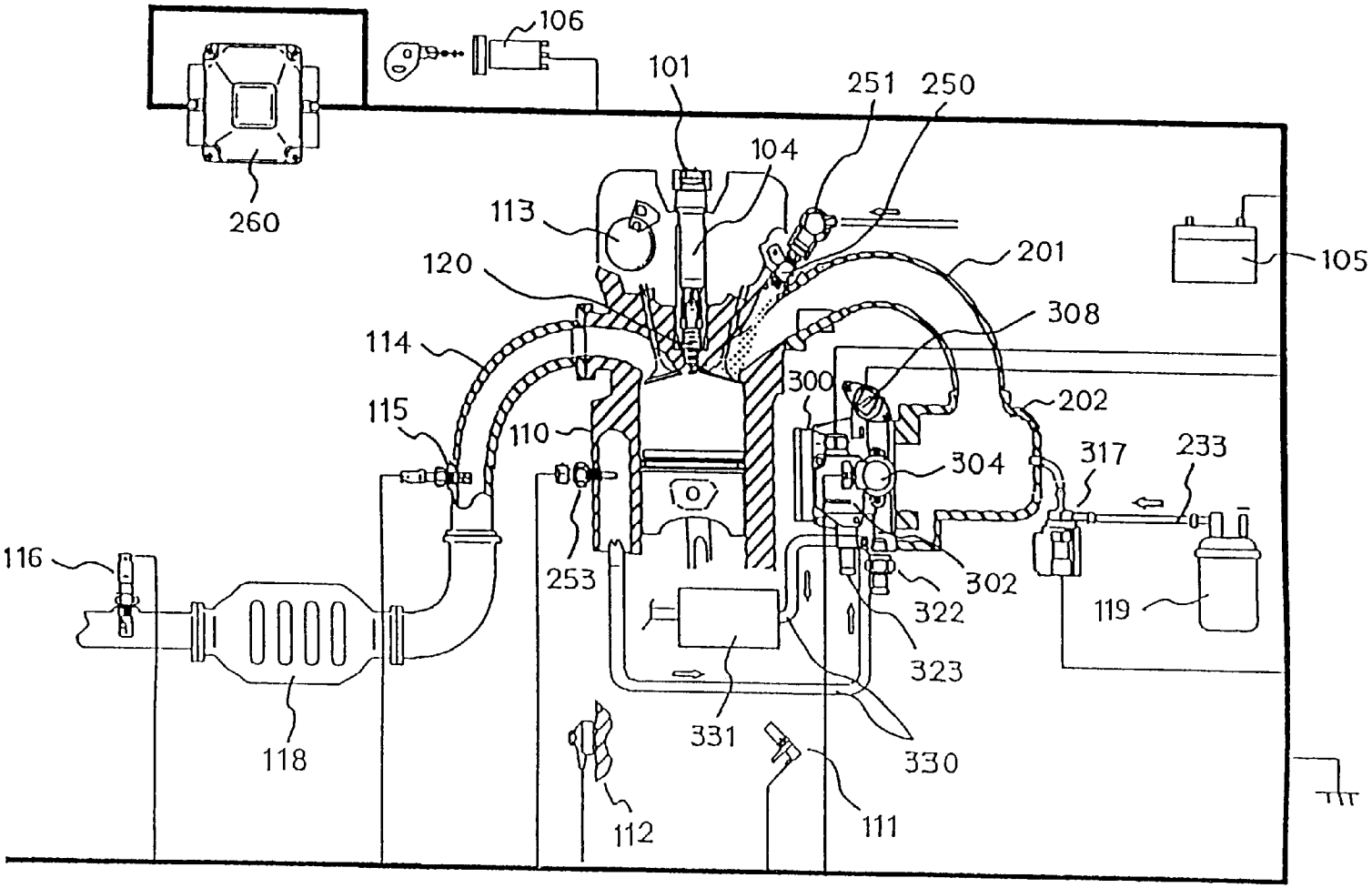
FIG. 9 is a schematic view of an engine system to which the present invention is applied.

In FIG. 9, there is shown one of a plurality of cylinders 110 of the engine. Reference numeral 201 denotes an independent intake pipe constituting an intake manifold, and the intake manifold is constituted by independent intake pipes corresponding to the number of cylinders. Numeral 202 denotes a collector (a surge tank) positioned upstream of the intake manifold, and 300 denotes a throttle body internally provided with a throttle valve.

The throttle body 300 is provided, as a measuring system, with a throttle position sensor (hereinafter referred to as TPS) 304 for detecting an opening-degree of a throttle valve, and an air flow meter (hereinafter referred to as AFM) for detecting an intake air amount, and numeral 302 denotes a circuit substrate of AFM. Further, the throttle body 300 is provided with an idle speed control valve (hereinafter referred to as ISC) 308.

The independent intake pipe 201 is branched from the collector 202 and connected to an intake port of the cylinder 110.

Air taken from an air cleaner not shown is controlled in flow rate by the throttle valve of the throttle body 300, after which reaches the collector 202, and is fed into the cylinder 111 at the intake stroke through the independent intake pipe (an intake manifold) 201.

An injector (fuel injection valve) 250 is arranged in the vicinity of an intake port of the cylinder 110 to inject fuel based on a control signal from an engine control unit (hereinafter referred to as ECU) 260 toward the intake valve.

Fuel is supplied to the injector 250 through a fuel gallery (a fuel supply pipe) 251.

In the present embodiment, an independent ignition type ignition coil 104 is directly connected to an ignition plug 120 mounted on the cylinder. The independent ignition type ignition coil 104 is mounted within a plug hole every cylinder 110, and an igniter unit (an ignition drive circuit) 101 is provided thereabove, so that an ignition signal is directly fed from ECU 260 to the igniter unit 101 for ignition control.

Reference numeral 105 denotes a battery; 106 an engine key switch; 111 a crank angle sensor; 112 a knock sensor for detecting knocking of the engine; 113 a cam angle sensor; and 115 and 116 $O_2$ sensors provided on an exhaust pipe 114. The $O_2$ sensors 115 and 116 are provided to control an air/fuel ratio, and are arranged before and after a catalyst 118 so as to enable detection of deterioration in performance of the catalyst.

Reference numeral 253 denotes a hot water sensor for detecting a temperature of an engine cooling water. Detection signals from the sensors and AFM are fed to ECU 260 through a harness. The ECU 260 has functions for calculating a fuel amount according to the engine condition and calculating an ignition timing in accordance with various measured signals and sensor signals.

A part of the engine cooling water passes through the wall part of the throttle body through a hot water system piping 330 to impart heat to the throttle body so as to prevent the throttle valve and the like from being frozen. Hot water (engine cooling water)is returned to an engine cooling part through a reserve tank 331 and a return pipe.

Reference numeral 119 denotes a canister for recovering vaporized gases of a fuel tank. The vaporized gases recovered by the canister 119 are fed to the collector 202 through a canister purge valve 317 and a canister purge pipe 233.

The canister purge valve 317 is also controlled through ECU260.

The throttle body 300 is provided with a PCV valve 322 used in a blow-by gas positive crankcase ventilation (Positive Crankcase Ventilation: hereinafter referred to as PCV), and a fresh air delivery port 323. PCV is provided to reduce blow-by gases taken out from a cylinder head cover or a crankcase to a passage of an intake system. When the blow-by gases are placed in the take-in state at the time of light load when the blow-by gases less occur, the attractive force caused by negative pressure from the manifold is too strong to place the engine in a bad condition. Therefore, there is used a PCV vale 322 having the construction in which a ventilation area of PCV is controlled by negative pressure of the manifold. The blow-by gases are fed downstream of the throttle valve according to the load (intake air amount) of the engine, and at that time, fresh air is fed into the cylinder head cover or into the crankcase through the fresh air delivery port and a hose (not shown) connected thereto from an intake system upstream of the throttle valve to effect ventilation.

Now, the intake module of the internal combustion engine according to thee present embodiment will be described with reference to FIGS. 1 to 8.

Figure 1:
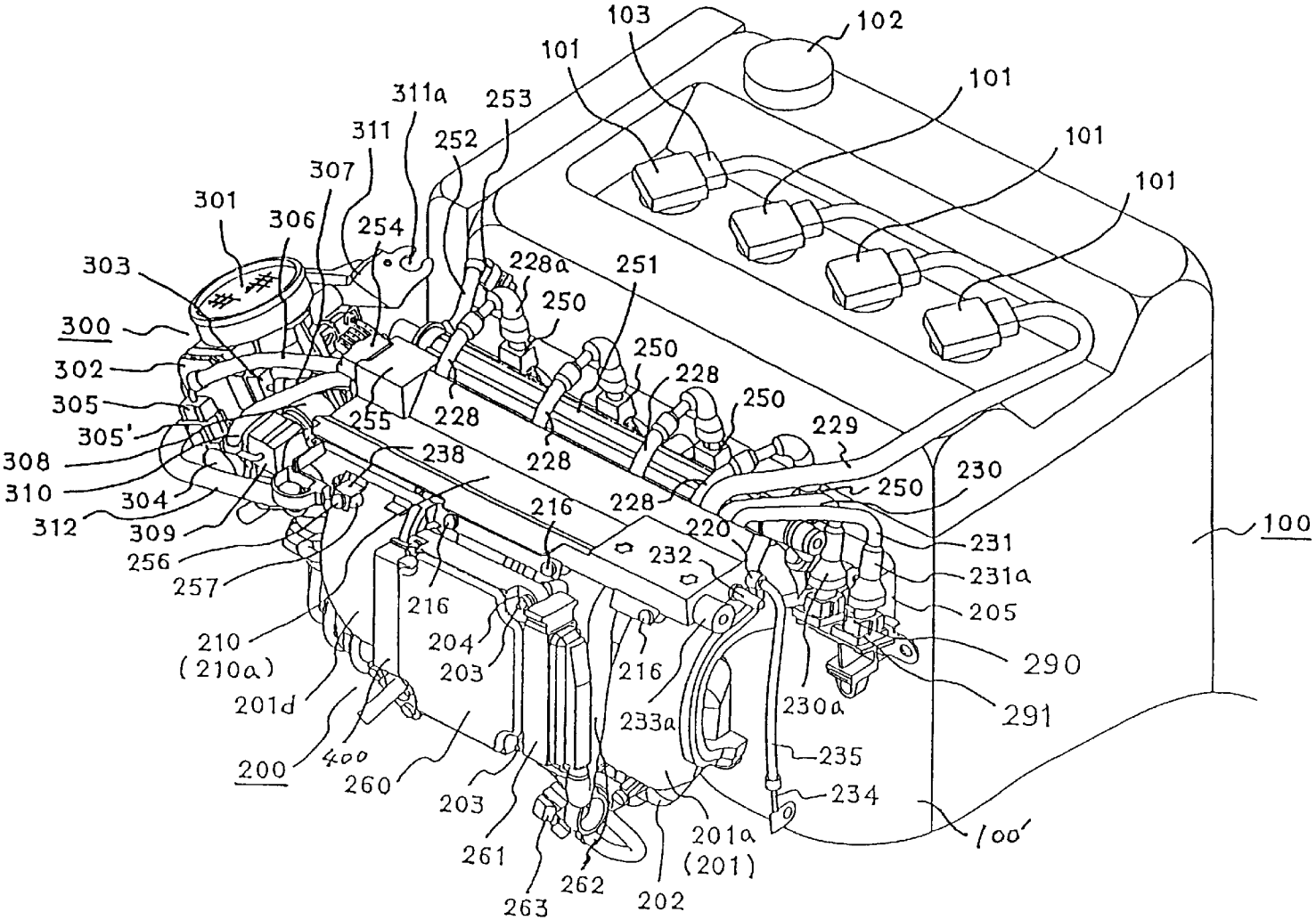
FIG. 1 is a perspective view showing the state in which an intake module 200 is mounted on an engine block 100.
Figure 2:
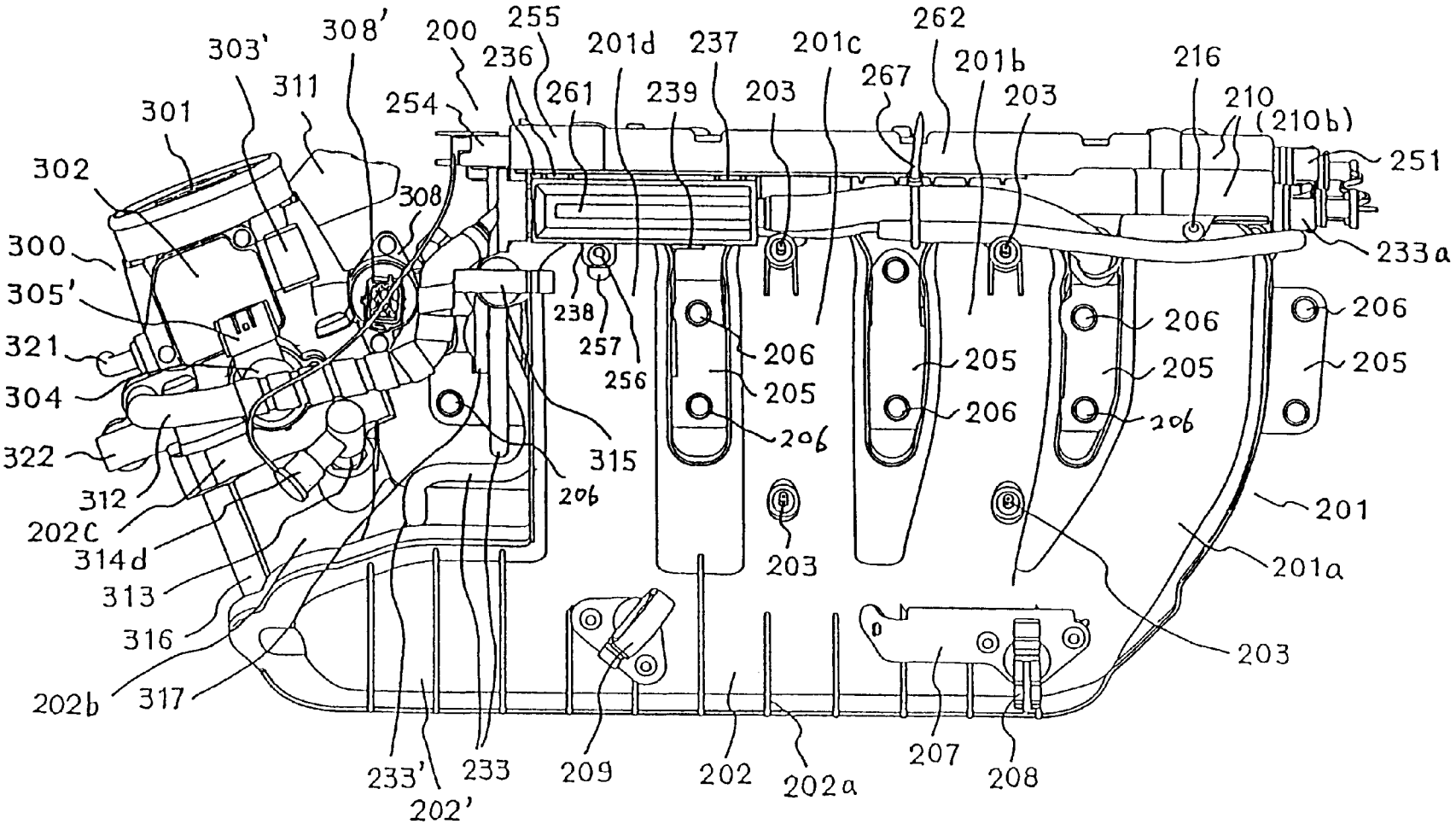
FIG. 2 is a front view showing, in the state in which the intake module 200 is removed from the engine block 100, the state in which ECU 260 is removed from the intake module 200.
Figure 3:
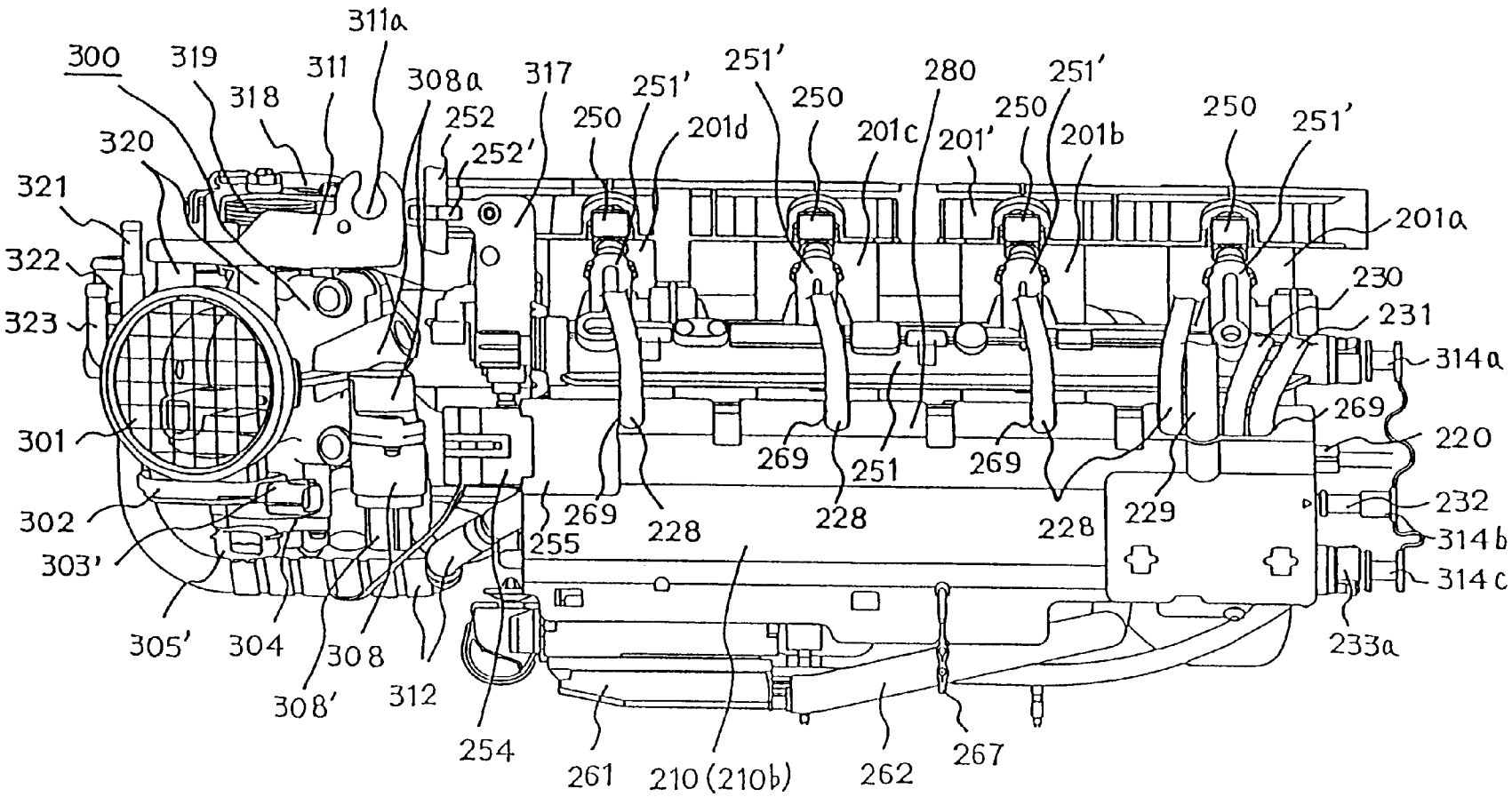
FIG. 3 is a top view of FIG. 2.
Figure 4:
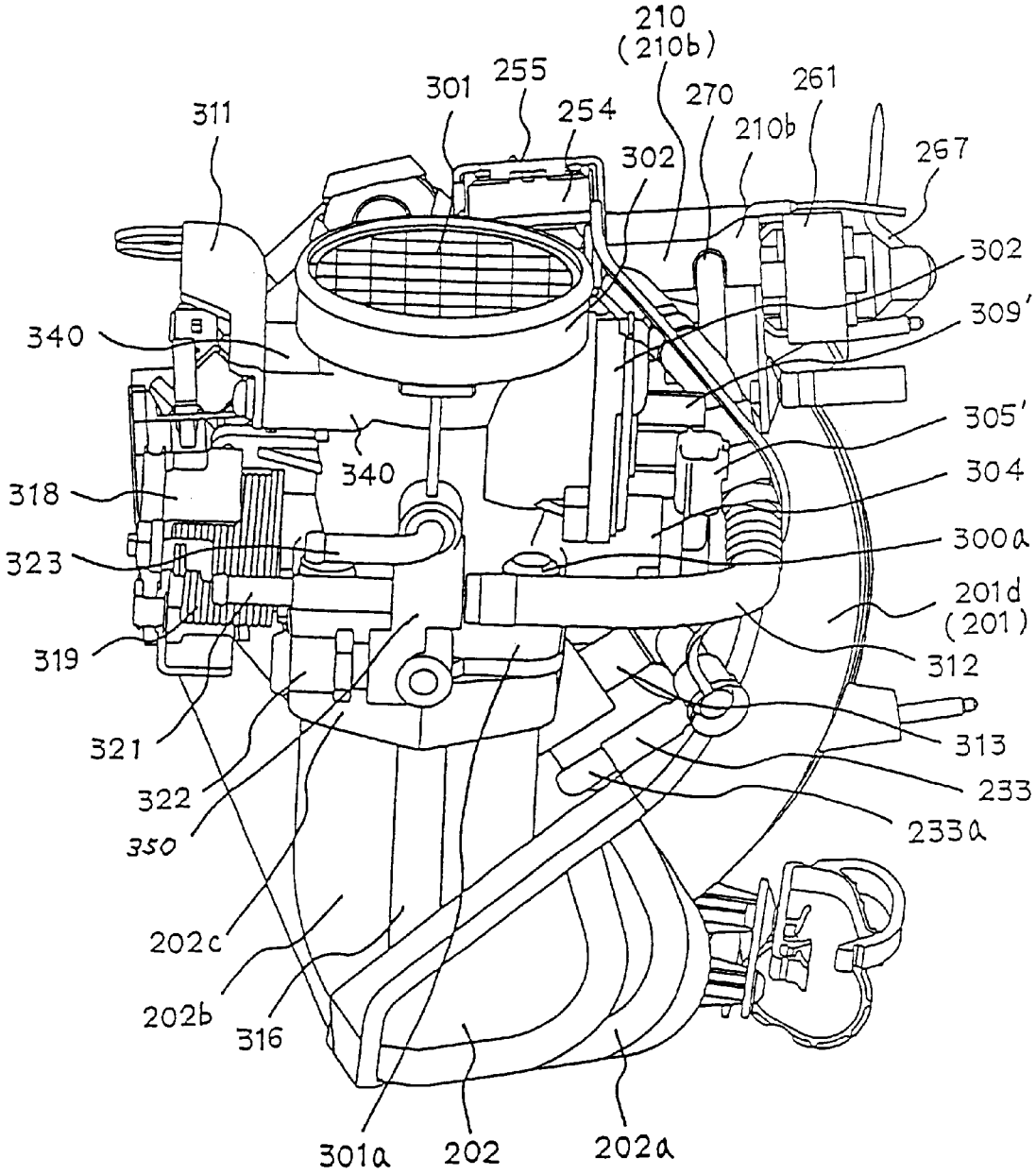
FIG. 4 is a left side view of FIG. 2.
Figure 5:
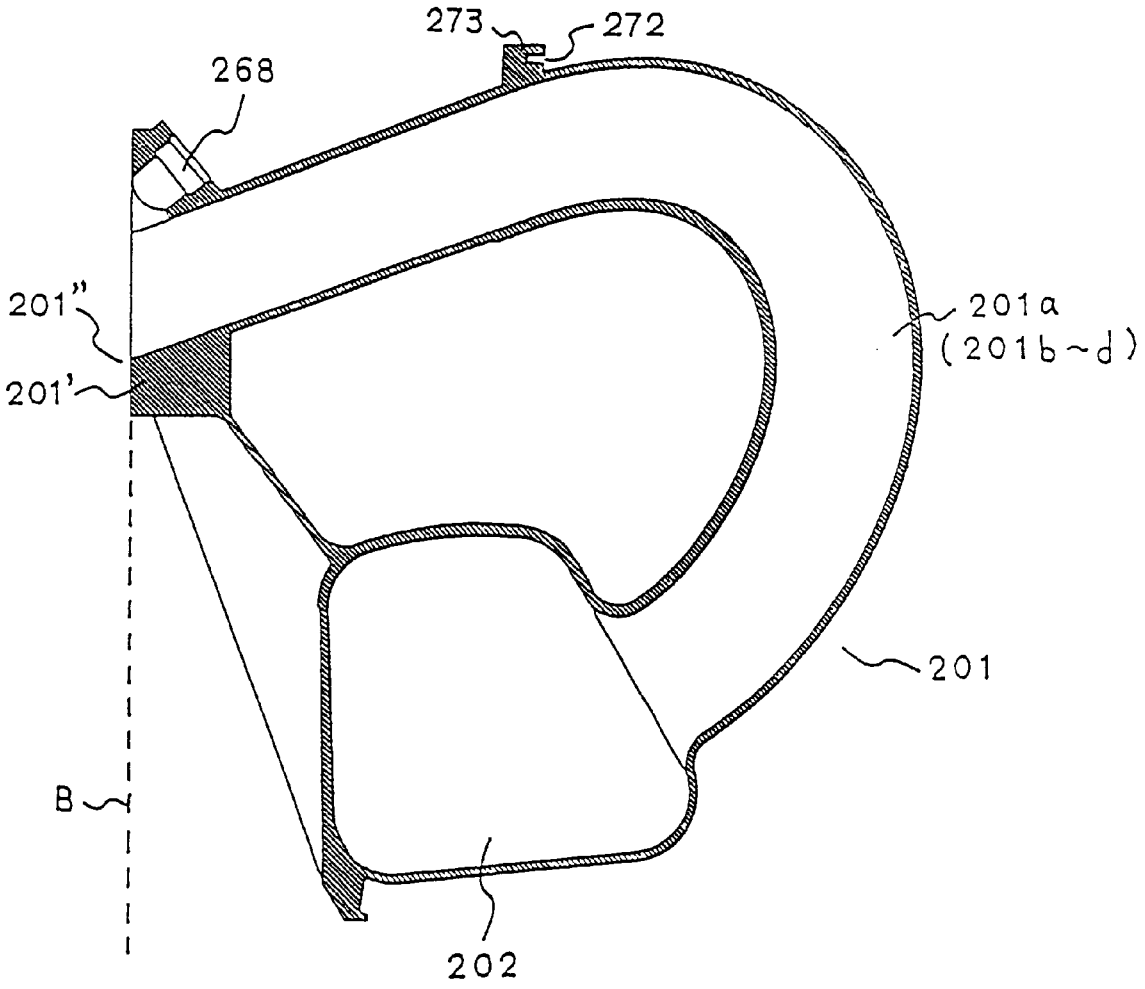
FIG. 5 is a longitudinal sectional view of an intake manifold 201 and a collector 202 constituting a main body of an intake module in the embodiment of the present invention.
Figure 6:
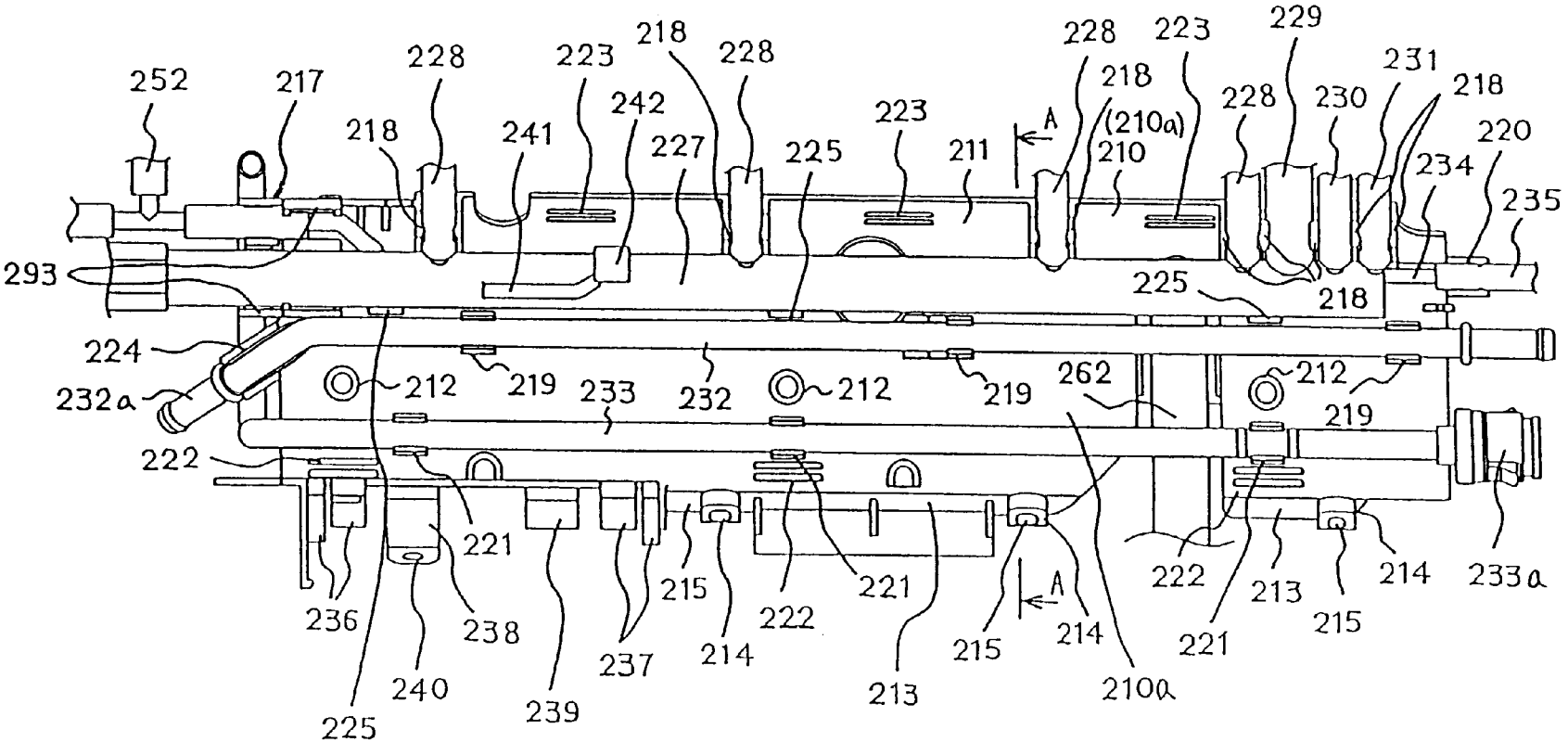
FIG. 6 is a top view, as viewed from above, of the interior of a holder (the interior of a lower cover 210*a*) with an upper cover 210 out of a synthetic resin holder 210 at the upper part of the body of the intake module 200 removed.
Figure 7:
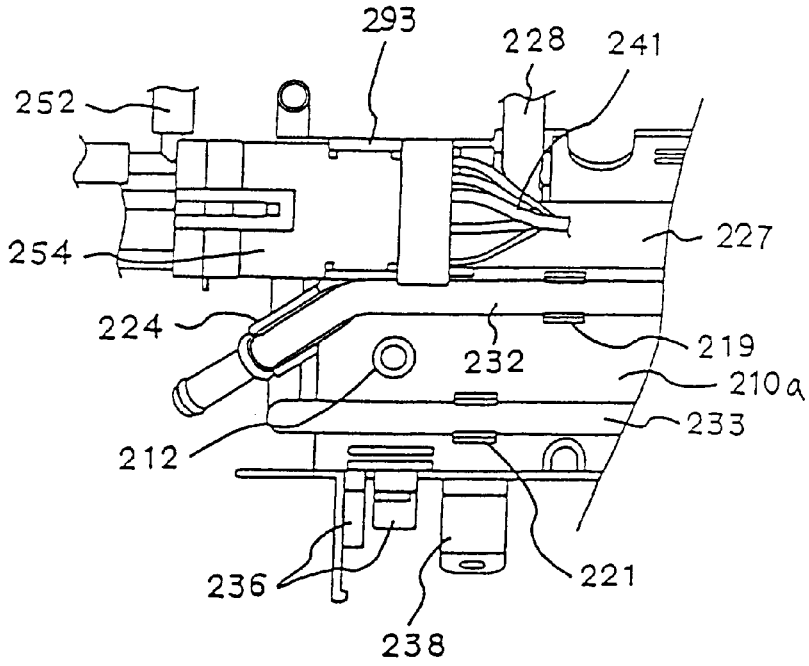
FIG. 7 is a partial top view showing the state in which an electrical connector 254 is mounted on part of FIG. 6.
Figure 8:
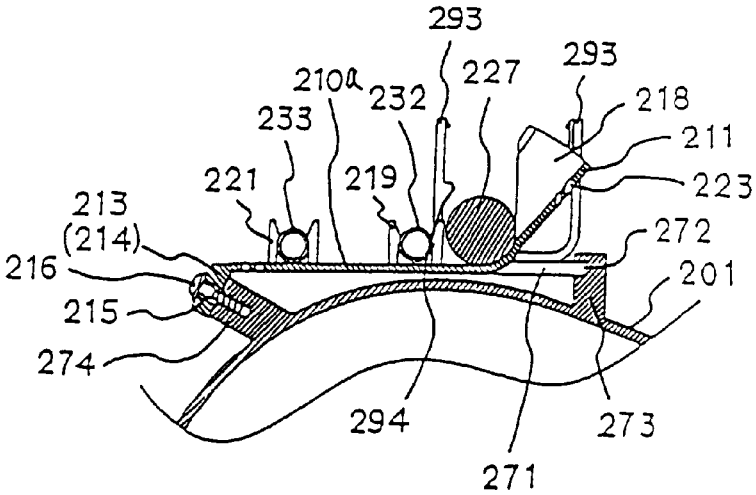
FIG. 8 is a sectional view taken on line A—A of FIG. 6.

FIG. 1 is a perspective view showing the state in which an intake module 200 is mounted on an engine block 100; FIG. 2 is a front view showing, in the state in which the intake module 200 is removed from the engine block 100, the state in which ECU 260 is removed from the intake module 200; FIG. 3 is a top view of FIG. 2; FIG. 4 is a left side view of FIG. 2; FIG. 5 is a longitudinal sectional view of an intake manifold 201 and a collector 202 constituting a main body of an intake module in the embodiment of the present invention; and FIG. 6 is a top view, as viewed from above, of the interior of a holder (the interior of a lower cover 210*a*) with an upper cover 210*b* out of a synthetic resin holder 210 at the upper part of the body of the intake module 200 removed. FIG. 7 is a partial top view showing the state in which an electrical connector 254 is mounted on part of FIG. 6; and FIG. 8 is a sectional view taken on line A—A of FIG. 6.

The intake module 200 according to the present embodiment is designed to be an element for not only, of course, parts of an intake system but a part of a fuel system, ECU, various harnesses (wiring) of an electric system and the like. With respect to the wiring, a so-called wiring module is first constructed, and with respect to the control system; ECU and a wiring module are combined to construct a control module. These wiring module and control module are incorporated into a module of an intake system to construct an intake module which is a single assembly (unit) as viewed as a whole.

Various modules as described above are collected into a single form to thereby provide rationalization of automobile assembling work, rationalization of transportation, compactness, enhancement of mounting properties, lower cost, lower resistance of harness, and anti-noise property, to which end various considerations are made as follows:

The intake manifold 201 and the collector 202 constituting the intake module body are integrally molded from synthetic resin excellent in heat resistance and mechanical strength.

The collector 202 is positioned at the lower part of the synthetic resin molded body, as shown in FIGS. 2 and 5, to have a laterally long shape, and has its upper surface integrally connected to the intake manifold 201.

The intake manifold 201 according to the present embodiment is illustrated as a 4-cylinder as one example, which is constituted by independent intake pipes 201*a*, 201*b*, 201*c* and 201*d*. However, it is not limited thereto but may be applied to various number of cylinders.

The independent intake pipes 201*a* to 201*d* have a shape curved as shown in FIG. 5, and one end of each independent intake pipe (upper end: opposite to the collector 202) 201' constitutes a peripheral part of an intake port. A surface 201" of the one end 201' of the independent intake pipe is connected to the peripheral edge of an intake port on the engine block 100 side through a seal.

The one ends 201' of the independent intake pipes 201*a* to 201*d* are laterally lined through flanges 205 (shown in FIG. 2) molded integral with the one ends 201'. The flange 205 is bored with a hole 206 for mounting an intake module. The mounting hole 206 is disposed in the periphery of an intake port, and a metal tube is inserted therein whereby the inside diameter of the metal tube will be the mounting hole 206.

A stud bolt mounted in advance on the engine block is extended through the mounting hole 206 and fastened with a nut whereby the intake module 200 is fixedly secured to the side wall surface 100' (FIG. 1) of the engine block as shown in FIG. 1.

A surface formed by extending downward one end surface 201" of each independent intake pipe 201 shown in FIG. 5 (a surface vertical to the paper surface along the broken line B) corresponds to the side wall surface 100' when the intake module 200 is mounted on the side wall surface 100' of the engine block. Accordingly, as is apparent from FIG. 5, the collector 202 is at a position withdrawn from one end surface 201" of the independent intake pipe when the side wall surface 100' of the engine block is viewed as a reference so as not to come in contact with the side wall surface 100' of the engine block.

One end (upper end 201') of the independent intake pipes 201*a* to 201*d* is formed with a hole 268 for mounting an injector toward the intake port, and an injector 250 is mounted in the hole as shown in FIGS. 1 and 3. Further, as shown in FIG. 3, a fuel gallery (a fuel supply pipe) 251 is mounted between the mounting position of the injector 250 and a synthetic resin holder (a holder for holding a harness and piping) 210 described later whereby the fuel gallery 251 is also incorporated as a module element into the intake module 200.

A lateral one end 202' of the collector 202 is projected laterally from one side surface of the intake manifold 201 as shown in FIG. 2, and an air take-in part 202*b* is provided integral with the collector 202 on the upper surface of the collector at that projected position. The air take-in part 201 is inclined in the direction away from the intake manifold 201 as it is extended upward.

An opening of the air take-in part 202*b* of the collector 202 is directed toward the top side (so-called upward direction), and a flange 202*c* in the peripheral edge of the opening (see FIG. 2) is inclined to be a down slope as viewed from the intake manifold 201. Accordingly, the opening of the air take-in part 202*b* is also inclined to be a down slope as viewed from the intake manifold 201.

The air take-in part 202*b* of the collector 202 is present by the side (side surface) of the intake manifold 201, and a throttle body 300 is mounted in a flange 202*c* of the opening of the air take-in part 202*b*. The inclination of the throttle body 300 is the same as the direction of inclination of the air take-in part 202*b* on the collector side. Further, an opening 301 on the air take-in side of the throttle body 300 is also inclined in the same direction as the air take-in port (flange 202*c*) of the collector (that is, inclined to be a down slope as viewed from the intake manifold 201 side).

The air take-in part 202*b* and the throttle body 300 are inclined as predetermined, as described above, whereby an upwardly widened space is secured between the throttle body 300 and the intake manifold 201, and an ISC valve 308 is arranged between the throttle body 300 and the intake manifold 201 making use of the spread of the space.

The air take-in side of the collector 202 is projected laterally from the intake manifold 201 as described above, and the air take-in part 202*b* and the throttle body 300 are arranged on the projected upper surface to thereby enable realization of an intake module body in which the throttle body with an ISC valve, the intake manifold 201 and the collector 202 are collected.

The air take-in port 301 of the throttle body 30 is formed with the oblique slope as described above to thereby make an R of a duct great when the intake duct (not shown) is mounted in the air take-in port 301 obliquely and upwardly to minimize aerodynamic resistance of the intake duct.

In FIG. 2, the collector 202 is formed on the outer wall thereof with a rib 202*a*, and holders 208 and 209 for holding a part of harness (not shown) other than the module element of the intake system module 200, and a bracket 207 are mounted. The harness other than the module element can be electrically connected to a connector terminal 400 provided on one side of the ECU 260 shown in FIG. 1 through a connector (not shown) on the harness side. In FIG. 1, a connector terminal similar to the connector terminal 400 is also secured to the other side of the ECU 260 (In FIG. 1, since this connector terminal is connected so that the connector 261 on the harness 262 side arranged on the intake module 200 is placed over the connector terminal, it is not visible).

The throttle body 300 is internally provided with a throttle valve (not shown), and on the outer wall thereof are mounted, in addition to the ISC valve 308, a circuit substrate 302 of AFM for detecting an intake air amount, TPS 304 for detecting an opening-degree of a throttle valve, a throttle lever 318, a return spring 319, PCV valve 322, a nipple 323 for delivering fresh air, a pipe for hot water 321 and the like. The pipe for hot water 321 is mounted on a heat transfer part 350 of the throttle body 300 to impart heat to the throttle body 300 through a part of engine cooling water (hot water) introduced through piping, thus preventing the throttle valve at the time of operation in a cold district from being frozen.

The circuit substrate 302 of AFM is housed in a casing and screwed to the side wall of the throttle body 300. AFM comprises, for example, a thermal air flow meter, and a sub air passage (not shown) for measuring air flow-rate is provided in a main passage internally of the throttle valve 300.

Further, the throttle body 300 is provided with a bracket 311 for an accelerator wire guide on the throttle lever 318. The bracket 311 is screwed to a plurality (for example, two) of projections 340 projected on the side wall of the throttle body as shown in FIG. 4. A circular cut 311*a* provided in the extreme end of the bracket 311 serves as a guide for getting the accelerator wire through.

These mounting articles are laid out in consideration of intensification of formation of module. For example, the ISC valve 308 and its passage 308*a* are positioned between the throttle valve 300 and the intake manifold 201. The throttle lever 318, the return spring 319, and the bracket 311 are mounted on the side wall surface of the throttle body 300, the circuit substrate 302 of AFM and TPS 304 are disposed on the opposite side wall surface, and the PVC valve 322, the delivery part (nipple) 323 for fresh air, and the pipe 321 for hot water are mounted on the side wall opposite to the mounting side of the ISC valve 308.

As shown in FIG. 2, the AFM circuit substrate 302 is positioned above the TPS 304, and a connector (a terminal) 305' of the TPS 304 has its receiving port directed upward and formed upwardly, the connector 305' being arranged in an overlapping relation with the AFM circuit substrate 302. In this manner, an arranging space for the connector on the side wall of the throttle body is rationalized.

A connector 308' on the ISC valve 308 side faces to the side surface on the side on which the AFM circuit substrate 302 and the TPS 304 are provided, and the connector 303' on the AFM circuit substrate 302 side is directed to the connector 308' of the ISC valve. In this manner, these connectors 305', 308' and 303' come closer so that the connecting work for the harnesses may be carried out simply at the close position.

In the air take-in part 202*b* of the collector 202, a blow-by gas passage 316 is molded integrally with the collector 202 at the extreme end in the lateral length direction, the blow-by gas passage 316 having an inlet side communicated with the PCV valve 322 on the throttle body 300 side and an outlet side positioned internally of the collector 202. The blow-by gas taken through the PCV valve 322 is fed into the collector 202 through the blow-by gas passage 316.

A vacuum take-out nipple 313 for a brake booster is mounted on the outer wall surface of the air take-in part 202*b* of the collector 202, and the nipple 313 is also incorporated as a module element of the intake module.

The harness connection of various sensors and various devices, and hose connection of a piping system such as the pipe for hot water 321 described above will be mentioned later.

While in the present embodiment, the ECU 260 and the harness 262 connected thereto constitute the control module of the internal combustion engine as shown in FIG. 1, it is noted that this control module is also incorporated as a module element of the intake module 200 to increase the mounting density of the module and the number.

That is, the ECU 260 is detachably secured to the wall surface on the front side (front side of the independent intake pipe and the intake manifold) of the intake module body, and the harness 262 connected to ECU 260 through the connector 261 is also held. The harness 262 bundles wirings of various sensors (for example, signal wirings for the water temperature sensor 253, the AFM circuit substrate 302, the TPS 304, the crank angle sensor 111, the knock sensor 112, the cam angle sensor 113 and the like), the signal wirings for the injectors .250, and the signal wirings of the ignition coil 104 system.

As viewed systematically, the channel is from the harness 262 to the harness 227 shown in FIG. 6, which is then branched into the harnesses 228, 229, 230, 231, 252 and the like. Where these harnesses are mounted on the intake module 200, the harness 227 is first installed on the lower cover 210*a* (FIG. 6) of the holder 210 described later, the harness 262 is drawn to the lower side therefrom, and drawn to the front side through part under the bottom of the lower cover 210*a* and part under the hot water pipe 232 and the canister purge pipe 233.

In mounting the ECU 260, a plurality (for example, four) of stud bolts 203 are disposed on the front wall surface of the intake manifold 210 (in the present embodiment, the front wall surfaces of the independent intake pipes 201*b*, 201*c*), and the nut 204 is fastened to the stud bolt 203 through a mounting hole provided in the ECU 260 whereby the ECU 260 is fixed.

Where the ECU 260 is fixed by the nut 204 using the stud bolt 203 as described above, for example, the intake module 200 is mounted within the engine room, after which when the ECP 260 is removed or mounted in view of necessity of maintenance and replacement, the nut 204 is loosened or tightened from the above of the engine room using a spanner to detachably mount the ECU 260. Therefore, even at a place where parts are jammed, the detachably mounting work for ECU can be made without interfering with other parts.

FIG. 2 shows the state before the ECU 260 is incorporated into the intake module, at which time the connector 261 on the harness 262 side for connecting ECU is held by holding members 236, 238 and 237, 239 to enable temporary stopping state, thereby avoiding hanging of the connector 261. At this time, the harness 262 is held by a holder 267.

In the present embodiment, the harness (wiring module) of various parts and piping members are also incorporated as the element of the intake module 200 in the manner as described below to provide mounting of the module with higher density.

The synthetic resin holder 210 of the laterally elongate case type is mounted on the upper part of the intake manifold 201 constituting the body of the intake module 200, i.e., on the surface directed at the top side of the independent intake pipe 201*a* to 201*d* curved, the harness and the piping system member are passed through the holder 210, and these harness and piping member, that is, the held members are held (secured) by means of a clasp provided internally of the holder 210.

The detailed form will be described in detail below.

In the synthetic resin holder 210, a panel-like upper cover 210*b* and a lower cover 210*a* (FIG. 6) constitute a holder body. In FIGS. 1 to 4, only the upper cover 210*b* appears (the lower cover 210*a* cannot be seen because the upper cover 210*b* is placed thereover), and in FIG. 6 with the upper cover 210*b* removed, the internal construction of the lower cover 210*a* appears in the direction of the upper surface.

First, the constitution of the lower cover 210*a*, the mounting construction, the harness secured thereto, and the piping member will be mainly described with reference to FIGS. 6 to 8.

The lower cover 210*a* is fixed upwardly to the surface directed at the top side of the independent intake pipes 201*a* to 201*d*. The mounting construction is shown in FIG. 8 (FIG. 8 is a sectional view taken on: line A—A of FIG. 6).

As shown in FIG. 8, the lower cover 210*a* has its back (a back panel part) obliquely risen with part thereof being left, a part (a part on the independent intake pipes 201*a* to 201*d*) 271 is placed in a horizontal state, and the part serving as an insert 271 is fitted in a groove 272 of a holder mounting projection 273 provided on the independent intake pipes 201*a* to 201*d*. Its front panel part 213 is molded having an inclination obliquely downward, a projected part 214 provided on the front panel part 213 is formed with a threaded hole 215 (see FIG. 6), and the lower cover 210*a* is fixed by a screw 216.

Internally of the lower cover 210*a* are disposed clasps 217, 218, 219, and 221 for detachably fixing the held members (such as the harnesses 227, 228, the pipe for hot water 232, the canister purge pipe 233 and the like). In the present embodiment, a clip for holding the held member by the elastic force is illustrated as one example of these clasps, but it is not limited thereto but other hooks or the like having elasticity will also suffice. These clips are molded integrally with the lower cover 210*a*.

Of the members held on the lower cover 210*a*, the harness 227 is a wiring module having a power supply wiring, an electric wiring for an injector, wirings of various sensors for the TPS 304, AFM and the hot water sensor 253, a wiring of an ignition coil system, and an electric wiring for the canister purge valve (CPV) 317 bundled into one.

The harness 227 is at a position near the back panel part 211 of the inner bottom of the lower cover 210*a*, and is arranged laterally lengthwise of the lower cover 210*a* along the back panel part 211. In the fixing of the harness 227, it is pressed from the above by a clip 242, and a deviation in position in a longitudinal direction is prevented by a guide 225.

The electrical wiring for an injector out of the harness 227 is separated from the harness 227 within the holder 210 and drawn as shown in the harness 228 (the harness 228 is one in which an electric wiring for an injector separated from the harness 227 is covered with a flexible tube), is introduced to the injector 250 arranged at the back (upper end of the independent intake pipes 201*a* to 201*d*) of the intake module through a wiring drawing part provided in the back panel part of the holder 210, and is connected to the injector 250 through the connector 228*a*.

The back panel part of the holder 210 comprises a back panel part 211 on the lower cover 210*a* side, and a back panel part 280 on the upper cover 210*b* side, as shown in FIG. 3. The wiring drawing part for drawing the harness 228 comprises a clip 218 (FIG. 6) for fixing a harness provided on the back panel part 211 of the lower cover 210 a, and a harness through part (a cut close to U-shape) 269 provided on the back panel part 280 on the upper cover 210*b* side.

The harnesses 227 and 228 and the wiring drawing part are laid out whereby the harness for an injector 228 can be removed easily at a position near the injector 250 to provide simplification of the connecting work of the harness 228 to the injector 250, and shortening of the harness.

Further, an ignition harness 229, a harness for a cam angle sensor 230, and a harness for a knock sensor 231 are drawn from the harness 227 in line with the harness for an injector 228 at a position near one end in a lateral direction of the holder 210 (in FIG. 6, the lower cover 210*a*) as shown in FIG. 6, and are connected through the connector to the igniter unit 101 (FIG. 1) on the engine block side, the cam angle sensor 113 (FIG. 9) and the knock sensor 112 (FIG. 9), through the wiring drawing part of the back panel part similarly to the above. Accordingly, the harness formed into a module can be connected at a position near the various sensors and the igniter unit to provide shortening.

Out of these, the ignition harness 229 is guided into the engine head cover above the engine block as shown in FIG. 1, which is again separated into harnesses corresponding to the dependent type ignition coils, and the connector 103 on the harness side is inserted into a terminal (a connector) of the igniter unit 101 of the ignition coil, whereby the ignition harness 229 is connected electrically to the igniter unit.

The harness for a cam angle sensor 230 is connected to a relay connector 290 for a cam angle sensor provided on one end of the bracket 205 of the intake model 200 as shown in FIG. 1. The harness for a knock sensor 231 is also connected to a relay connector 291 for a cam angle sensor provided on one end of the bracket 205 of the intake model 200.

The harness drawing construction for drawing the ignition harness 229, the harness for a cam angle sensor 230, and the harness for a knock sensor 231 from the back panel part is also fundamentally similar to that of the harness for an injection describe above.

The harness 235 of an earth wiring 234 other than the above-described harness is drawn out of one end of the harness 227, and drawn outside through the guide 220 provided on one end of the holder 210.

The lower cover 210*a* is formed at the other end (in FIG. 6, one end on the left hand) with a clip 293 for holding a power supply connector, the clip 293 having the height sufficiently higher than the harness 227 as shown in FIG. 8, and a stop part (a projected part) 294 is provided internally of the clip 293 and in the midst of the heightwise. While in FIG. 6, the power supply connector is not held on the clip 293 but the held state is shown in FIG. 7.

The power supply connector is indicated by reference numeral 254, which is held by the clip 293 and received by the stop part 294 and is fixed on the harness 227.

Reference numeral 241 denotes a harness connected to the power supply connector 254, the harness 241 being incorporated halfway into the harness 227 as shown in FIG. 6.

In the present invention, the wiring module (systematically, the harnesses 228, 229-227, 262, 306, 307, etc.) provided with the ignition connector 103, the connector for an injector 228*a*, the connector 303 for AMF, the connector 305 for TPS, and the connector 261 for ECM is provided to realize intensification and shortening of the harnesses for the intake systems, ignition systems, and fuel systems.

On the lower cover 210*a* of the holder 210 are arranged a metal pipe (the pipe for hot water 232) constituting a part of the hot water piping system and the canister purge pipe 233 in a lined relation.

The metal pipe 232 as a pipe for hot water constitutes a part of a piping system for guiding engine cooling water toward the throttle body 300, the length thereof is made somewhat longer than the lateral length of the holder 210, a major portion thereof is housed in the holder 210, and both ends thereof is projected from the holder 210.

The metal pipe 232 is held by the clip 219 on the lower cover 210*a* as shown in FIG. 6. Numeral 224 denotes a guide for guiding one end of the metal pipe 232 to outside on the throttle body 300 side.

Both ends of the metal pipe 232 has a nipple shape, one end 232*a* of which is connected to a hot water passage (a pipe for hot water: metal pipe) 321 on the throttle valve 300 side through a rubber hose 312 (FIG. 4). In this manner, the metal pipe 232, the rubber hose 312 and the metal pipe 321 in the hot water piping system are incorporated as the module elements of the intake module.

The other end 232*b* of the metal pipe 232 is connectable with a rubber hose (not shown) for supplying engine cooling water not to be a module element. The rubber hose not to be a module element is varied in length according to the kind of vehicles and types, in consideration of which piping parts within the range capable of being united, that is, the metal pipes (pipe for hot water) 321, 232, and the rubber hose 312 are formed into a module. The use of the metal pipe 232 can select a rubber hose having a suitable length according to the kind of vehicles, with respect to the rubber hose to be connected to one end 232*b* to enable exchangeability. This hose is not limited in quality to rubber but suitable quality can be selected.

At a position in which both ends of the metal pipe 232 are projected from the holder 210, the rubber hose is connected to both the ends, whereby even if a water leakage should occur in the rubber hose connecting part, no water stays in the holder 210, and accordingly, the electric insulation of the harness can be secured. By taking the foregoing into consideration, even if the harness and the hot water piping should be housed together into the holder 210, the reliability relating to the insulation can be secured to provide compatibility with the promotion of forming into module.

Further, in the present embodiment, the canister purge pipe 233 is also housed and held in its majority by the holder 210.

The canister purge pipe 233 comprises a nylon pipe, and is held on the clip 221 provided on the lower cover 210*a* as shown in FIG. 6. Out of the canister purge pipe 233, one drawn out on the throttle body 300 side from the holder 210 is connected in one end 233' to the collector 202 through the canister purge valve 317 as shown in FIG. 2 so as to return vaporized gas to the intake system. On the other end thereof is provided a coupling 233*a*, which can be connected to an external canister purge pipe not formed into module. Also in this arrangement, the exchangeability is provided leaving a room capable of selecting a pipe having a suitable length according to the kind of vehicles similar to the above-described hot water piping.

The canister purge pipe 233 is made of nylon, but according to the present constitution, it is protected by the cover member 210*a*, 210*b* of the holder 210, and even if the canister purge pipe 233 is formed into module, it does not interfere with other parts or does not receive the external force to become broken, thereby enabling enhancement of reliability and safety.

Since the intake module 200 shown in the figure is in the state before use, dust covers (blind plugs) 314*a* to 314*d* are mounted in an opening end of the fuel gallery 251, an opening end of the pipe for hot water 232, an opening end of the canister purge pipe 233, and a vacuum take-out port 313 for a brake booster as a module element.

The upper cover 210*b* is partly fitted into slits 222 and 223 provided in the front and back panel part of the lower cover 210*a* and can be detachably mounted. The projection 212 shown in FIG. 6 is provided to support the upper cover 210*b* when the latter is placed on.

Reference numeral 252 denotes a harness for a water temperature sensor, and 253 denotes a water temperature sensor for detecting a temperature of engine cooling water.

Where the intake module described above is mounted on the engine 100, as shown in FIG. 1, an ignition coil is mounted on the cylinder head part of the engine 100 independently every cylinder, an independent intake pipe molding body 201 constituting an intake manifold is mounted on the side of the engine, and the injector 250 is mounted in the periphery of an intake port of the engine at a part between the intake pipe molding body 201 and the ignition coil. ECU 260 is mounted on the side, of the intake pipe molding body 201, farthest from the engine, and a wiring bundle is held by the intake pipe molding body at a part between the ECU 260 and the injector 250.

In the case of the constitution as described, a wholly compact module can be constituted. ECU 260 is present farthest from the engine for the module 200, and is mounted on the wall of the intake pipe receiving air cooling action, because of which it is installed at a reasonable position within the engine room to guarantee the heat resistance.

When the module elements are increased, the vehicle is miniaturized and light-weighted, the electric system harness and piping member are intensified to simplify the vehicle assembling work, the engine room being made higher in density is simplified to secure more effective space in the engine room than that of prior art, or the mounting of parts into the narrow engine room with high density can be further enhanced.

Further, the harness is formed into module, and control devices such as ECU and parts to be controlled such as the injector, and various sensors are formed into module together with the harness in connection therewith, whereby the harness can be shortened.

Furthermore, since the intake module is mounted on the engine, the harness (module element) can be connected at a position close to electric parts (such as an ignition coil) on the engine side, which also shortens the harness. Accordingly, the resistance of the whole harness is minimized, and the anti-noise properties are promoted.

Moreover, the shortening and rationalization of the piping system can be realized by intensification to reduce the cost.

While in the above-described embodiments, the throttle body incorporated into the intake module is operated to open and close the throttle valve by the mechanical force of the accelerator wire, it is noted that instead, the so-called electronically controlled throttle body that electrically drives the throttle valve on the basis of a control signal of ECU may be applied.

Figure 10:
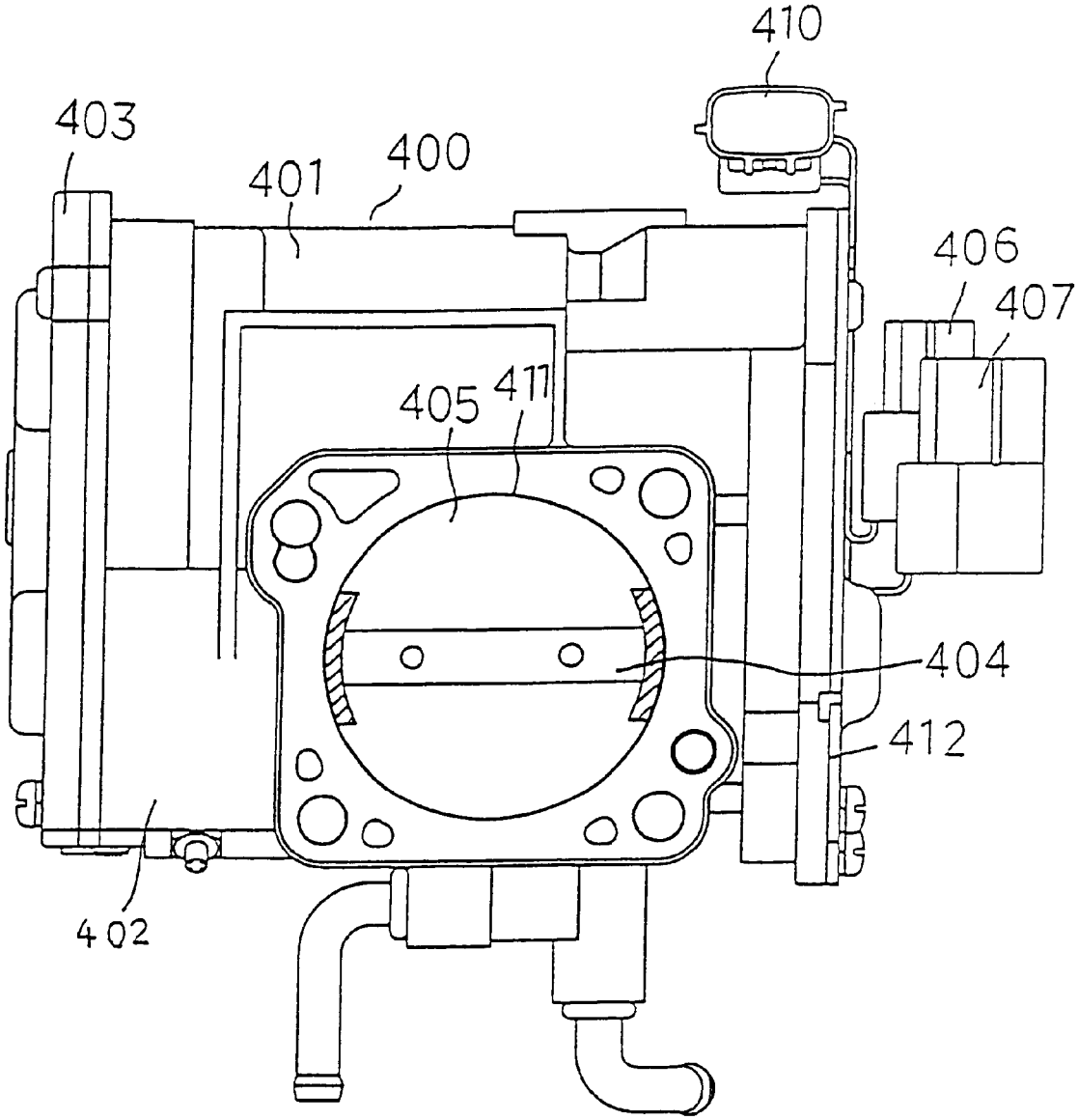
FIG. 10 is a front view showing a further example of a throttle body loaded on the intake module.
Figure 11:
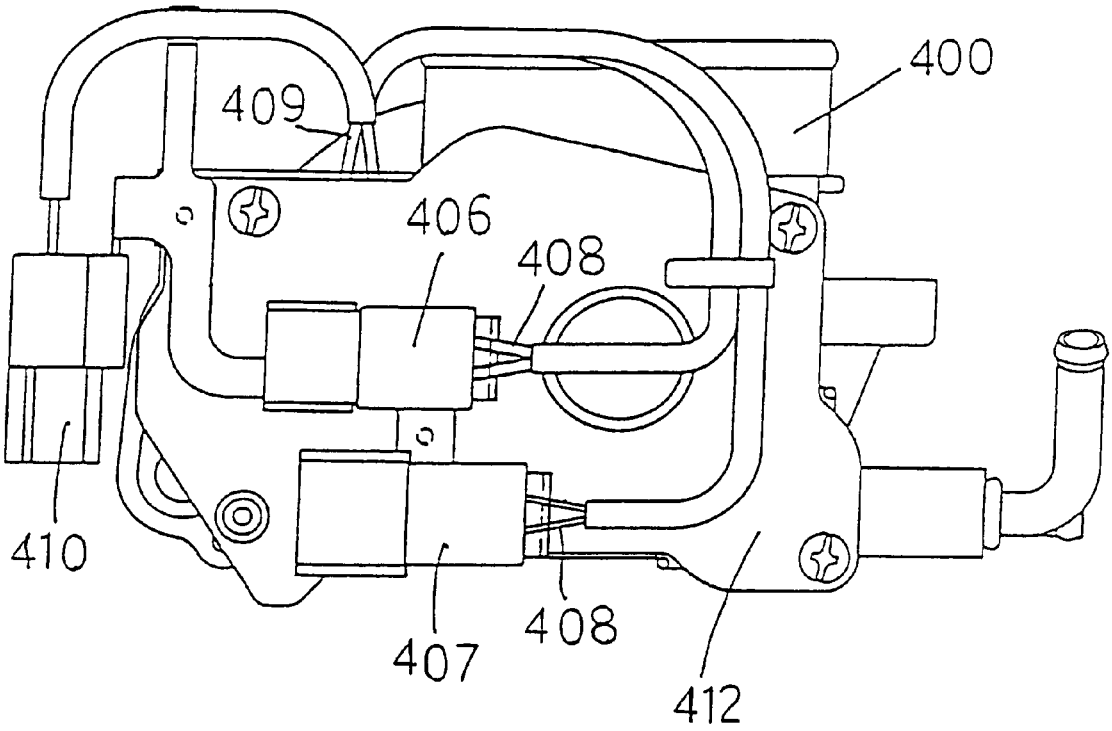
FIG. 11 is a right side view.

FIG. 10 is a front view showing one example of the electronically controlled throttle body, and FIG. 11 is a lower surface view thereof.

In these drawings, a motor casing 401 is formed at part of the outer wall of a throttle body 400, and power of a throttle actuator (motor) housed in the motor casing 401 is transmitted to a throttle valve stem 404 through a reduction gear within the gear casing 402 to control an opening degree of a throttle valve 405. The gear casing 402 is formed on the side wall of the throttle body on one end side of the throttle valve stem and is covered with a gear case cover 403.

TPS (throttle position sensor) is internally provided on the side wall on further one end side of the throttle valve stem of the throttle body 400, and is covered with a sensor cover 412.

On the sensor cover 412 are disposed a harness 408 (wiring) for TPS and its connectors 406 and 407. The provision of two connectors 406 and 407 avoids to be uncontrollable even if one of TPSs is in trouble, in case of the electronic control system. Reference numeral 409 denotes a harness for an actuator, and 410 denotes a connector thereof. Numeral 411 denotes a bore serving as an intake air passage.

Industrial Applicability

According to the present invention, as described above, in an intake module of an internal combustion engine of an automobile or the like, constituent elements of an intake module are increased more than that previously provided, and the layout is rationalized to enable enhancement of mounting density of modules, further simplification of assembling works of an intake module and a vehicle, and enhancement of convenience of transportation, smaller and lighter weight, and housing properties. Further, where the harness is formed into module, it is possible to enhance simplification of electric connections with relative parts, decreased resistance of harnesses, and anti-noise property, and the cost can be reduced. Also where the piping system is formed into module, piping is rationalized to reduce the cost.

What is claimed is:

1. An intake module for an internal combustion engine having an intake manifold and a collector made of synthetic resin, comprising a synthetic resin holder for holding at least one of a harness and a piping member mounted on the upper part of an intake module body, and the at least one of the harness and the piping member is incorporated as an intake module element, wherein the piping member comprises at least one of a pipe for hot water and a canister purge pipe.

2. The intake module for an internal combustion engine according to claim 1, wherein the synthetic resin holder comprises an upper cover and a lower cover, the lower cover is secured upward to the intake module body, the upper cover is detachably mounted so as to cover the lower cover, a clasp for detachably securing a member to be held is disposed internally of the lower cover, and the synthetic resin holder is formed with a guide part for introducing the held member internally and externally of the holder.

3. The intake module for an internal combustion engine according to claim 1, wherein an injector and a fuel gallery as a module element are mounted on the intake manifold, the harness comprises has at least a wiring for an injector and wirings for various sensors bundled into a single form, and the wiring for an injector is drawn within the synthetic resin holder and guided to the injector through a wiring drawing part provided on a back panel part of the synthetic resin holder.

4. The intake module for an internal combustion engine according to claim 1, wherein the harness has wiring made by a single bundle from a connector of an engine control unit, from which is branched into a bundle on an ignition side, and a bundle on an injector side.

5. The intake module for an internal combustion engine according to claim 1, wherein the intake module has an engine control unit secured to the outer wall of a molded body of an independent intake pipe of the intake manifold.

6. An intake module for an internal combustion engine constituted by an intake manifold, a collector, and a throttle body, wherein said module comprises a pipe for hot water having a length allowed to be incorporated into an intake module body, the pipe for hot water is housed in and held through a synthetic resin holder on a wall surface of the module body along with a harness, the pipe for hot water has one end connected through a hose to a hot water passage provided in a heat transfer part of the throttle body, the pipe for hot water, the hot water passage and the hose are incorporated as module elements, and the pipe for hot water has the other end connectable to an engine cooling water supply hose.

7. The intake module for an internal combustion engine according to claim 6, wherein the pipe for hot water is housed in the synthetic resin holder except both ends thereof, and the both ends of the pipe for hot water are extruded outside the holder and connected to the hose.

8. An intake module for an internal combustion engine having an intake manifold and a collector made of synthetic resin, comprising an engine control unit and a synthetic resin holder having a harness holding function are secured to a wall surface of an intake module body, and a harness connected through a connector to the engine control unit is incorporated into the synthetic resin holder as an intake module element, wherein a plurality of stud bolts are disposed on the wall surface of the intake module body, and the engine control unit is secured to the outer wall surface of the module body by fastening the stud bolts with nuts through mounting holes provided in the engine control unit.

9. The intake module for an internal combustion engine according to claim 8, wherein the harness has wiring made by a single bundle from a connector of an engine control unit, from which is branched into a bundle on an ignition side, and a bundle on an injector side.

10. The intake module for an internal combustion engine according to claim 8, wherein the engine control unit itself is also secured to the outer wall of a molded body of an independent intake pipe of the intake manifold.

11. An intake module for an internal combustion engine having an intake manifold and a collector made of synthetic resin, characterized in that a canister purge pipe is held by a holder on a wall surface of an intake module body, and the holder is provided with a protective cover for covering the canister purge.

12. An intake module for an internal combustion engine having a throttle body, an intake manifold and a collector formed into a module, wherein the intake manifold and the collector is integrally formed of synthetic resin, the collector is positioned at a lower part of the synthetic resin molded body, each curved independent intake pipe constituting the intake manifold is formed at one end thereof with an injector mounting part and an intake port peripheral part, an air intake part of the collector is located on one side of the intake manifold and is inclined upward and in a direction away from the intake manifold as the air intake part is extended upward, the throttle valve is mounted on a flange of the air intake part with the throttle body inclined in the same direction as the air intake part, and wherein a vacuum take-out port for a brake booster is connected in the vicinity of an air take-in port of the collector part disposed downstream of the throttle body.

13. An intake module for an internal combustion engine having a throttle body, an intake manifold and a collector formed into a module, wherein the intake manifold and the collector is integrally formed of synthetic resin, the collector is positioned at a lower part of the synthetic resin molded body, each curved independent intake pipe constituting the intake manifold is formed at one end thereof with an injector mounting part and an intake port peripheral part, an air intake part of the collector is located on one side of the intake manifold and is inclined upward and in a direction away from the intake manifold as the air intake part is extended upward, the throttle valve is mounted on a flange of the air intake part with the throttle body inclined in the same direction as the air intake part, and, wherein an air flow meter is arranged upstream of the throttle valve of the throttle body, and a circuit substrate of the air flow meter and a throttle position sensor are mounted on the same side of the throttle body.

14. An intake module for an internal combustion engine having a throttle body, an intake manifold and a collector formed into a module, wherein the intake manifold and the collector is integrally formed of synthetic resin, the collector is positioned at a lower part of the synthetic resin molded body, each curved independent intake pipe constituting the intake manifold is formed at one end thereof with an injector mounting part and an intake port peripheral part, an air intake part of the collector is located on one side of the intake manifold and is inclined upward and in a direction away from the intake manifold as the air intake part is extended upward, the throttle valve is mounted on a flange of the air intake part with the throttle body inclined in the same direction as the air intake part, and, wherein a connector terminal of the throttle position sensor and the circuit substrate of the air flow meter are arranged in an overlapping relation on the same surface side of the throttle body.

* * * * *